US007480212B1

(12) United States Patent
DuBreuil

(10) Patent No.: US 7,480,212 B1
(45) Date of Patent: Jan. 20, 2009

(54) MOTION-ACTIVATED REMINDER CALENDAR

(76) Inventor: Marc C. DuBreuil, 527 Joseph Ct., #2, Naples, FL (US) 34104

( * ) Notice: Subject to any disclaimer, the term of this patent is extended or adjusted under 35 U.S.C. 154(b) by 0 days.

(21) Appl. No.: 11/933,613

(22) Filed: Nov. 1, 2007

(51) Int. Cl.
*G04B 17/00* (2006.01)

(52) U.S. Cl. ..... 368/30; 368/28

(58) Field of Classification Search ..... 368/28–40; 40/107; 702/178; 705/9
See application file for complete search history.

(56) References Cited

U.S. PATENT DOCUMENTS 3,916,172 A * 10/1975 Engle, Jr. ..... 377/20
4,120,040 A * 10/1978 Aihara ..... 708/145
4,194,196 A 3/1980 Mohiuddin
4,630,934 A 12/1986 Arber
4,708,490 A 11/1987 Arber
D334,945 S * 4/1993 Hill ..... D19/20
D478,348 S 8/2003 Gladd et al.
7,218,203 B2 5/2007 Williams
7,376,909 B1 * 5/2008 Coyle ..... 715/778
2001/0036127 A1 * 11/2001 McCravy ..... 368/28
2003/0014296 A1 * 1/2003 Meine ..... 705/9
2004/0246106 A1 12/2004 Kain
2004/0252011 A1 12/2004 Williams
2005/0034338 A1 2/2005 Footman
2006/0250895 A1 * 11/2006 Sanchez ..... 368/29
2007/0075854 A1 4/2007 Tyler

* cited by examiner

*Primary Examiner*—Felix O. Figueroa
*Assistant Examiner*—Sean Kayes
(74) *Attorney, Agent, or Firm*—Lowndes, Drosdick, Doster, Kantor & Reed, P.A.; Angela M. Miller

(57) ABSTRACT

A motion-activated reminder calendar (1) having a front panel (38) and a rear panel (39) connected to one another by a plurality of sides (40), a calendar display (47) located on the front panel (38), a date display (4) having a plurality of day displays (9), a motion-activated sensor (5) electrically connected to a voltage source (34), a data storage means (42) electrically connected to the sensor (5), a record button (11) located on each day display (9) and electrically connected to the data storage means (42) and located on each day display (9) wherein the data storage means (42) records and stores the verbal reminders and a speaker (6) electrically connected to the data storage means (42) wherein the verbal reminder is transmitted through the speaker (6) on the selected day display (9) when motion is detected by the motion-activated sensor (5).

23 Claims, 2 Drawing Sheets

MOTION-ACTIVATED REMINDER CALENDAR

BACKGROUND OF THE INVENTION

This invention relates to calendars, more particularly, a motion-activated reminder calendar that automatically reminds a person of appointments, special days, meetings, etc. whenever motion is detected in the vicinity of the calendar.

Currently, traditional wall and desk calendars are commonly used to record important dates, events and appointments wherein a person writes the subject matter on the appropriate day. If the calendar is a paper calendar, as is the most commonly used type of calendar, a person writes the information on or adjacent to a pre-printed date block. In the alternative, a person may record the information in a special notes section on the calendar. These types of calendars are fixed, meaning that they are already pre-printed with the dates prior to the person using the calendar and are used for a predetermined amount of time.

In the alternative, some calendars are variable, meaning that a person may re-use the calendar by erasing or deleting the previous month's or the previous week's schedule. These types of calendars commonly utilize a dry erase board wherein the days of the week are pre-printed, but a person may write-in the month and days in a pre-printed grid.

Regardless of whether the calendars are fixed or variable, a person must always write the important event on the calendar itself and physically view the calendar prior to or on the day of the important event in order to remind himself or herself of the event. Although the process of viewing the calendar may not seem overly burdensome, many individuals have difficulty in remembering to view a calendar at all, thereby missing important events.

Moreover, although the use of electronic or computer-based calendars have become popular, the same problem exists wherein a person must be cognizant to view the electronic or computer-based calendar prior to or on the same day as the important event in order to remind himself or herself of the event. In addition, although pop-up reminders of important events are commonly used for computer-based calendars, a person must be in front of the computer to view the reminder.

Thus, a need exists for motion-activated reminder calendar that automatically reminds a person of appointments, special days, meetings, etc. whenever motion is detected in the vicinity of the calendar.

The relevant prior art includes the following references:

| Patent No. (U.S. unless stated otherwise) | Inventor | Issue/Publication Date |
|---|---|---|
| 2004/0252011 | Williams | Dec. 16, 2004 |
| 7,218,203 | Williams | May 15, 2007 |
| 4,194,196 | Mohiuddin | Mar. 18, 1980 |
| 2005/0034338 | Footman | Feb. 17, 2005 |
| 2004/0246106 | Kain | Dec. 9, 2004 |
| 4,630,934 | Arber | Dec. 23, 1986 |
| 4,708,490 | Arber | Nov. 24,1987 |
| D478,348 | Gladd et al. | Aug. 12, 2003 |
| 2007/0075854 | Tyler | Apr. 5, 2007 |

SUMMARY OF THE INVENTION

The primary object of the present invention is to provide a motion-activated reminder calendar that automatically reminds a person of appointments, special days, meetings, etc. whenever motion is detected in the vicinity of the calendar.

Another object of the present invention is to provide a motion-activated reminder calendar that is easy to use.

A further object of the present invention is to provide a motion-activated reminder calendar that permits a user to easily record an event on a selected day.

An even further object of the present invention is to provide a motion-activated reminder calendar that is portable.

The present invention fulfills the above and other objects by providing a motion-activated reminder calendar having a front panel and an opposing rear panel connected to one another by a plurality of sides, a calendar display located on the front panel, a date display having a plurality of day displays located on the calendar display, a motion-activated sensor electrically connected to a voltage source, a data storage means electrically connected to the motion-activated sensor, at least one record button electrically connected to the data storage means wherein the data storage means records and stores at least one verbal reminder for a day display upon activation of the one record button, the record button being located on each day display and a speaker electrically connected to the microprocessor wherein the verbal reminder is transmitted through said the speaker on the selected day display when motion is detected by the motion-activated sensor.

Additional features of the invention include an acknowledgment button that permits a user to deactivate the verbal reminder when the acknowledgment button is pressed, at least one visual indicator means, which is preferably an indicator light, located on each of the day displays, an increment button to program a reminder to be activated on a daily, weekly, monthly or yearly basis and a programmable clock that permits a user to program a predetermined time frame when the verbal reminders may be transmitted.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
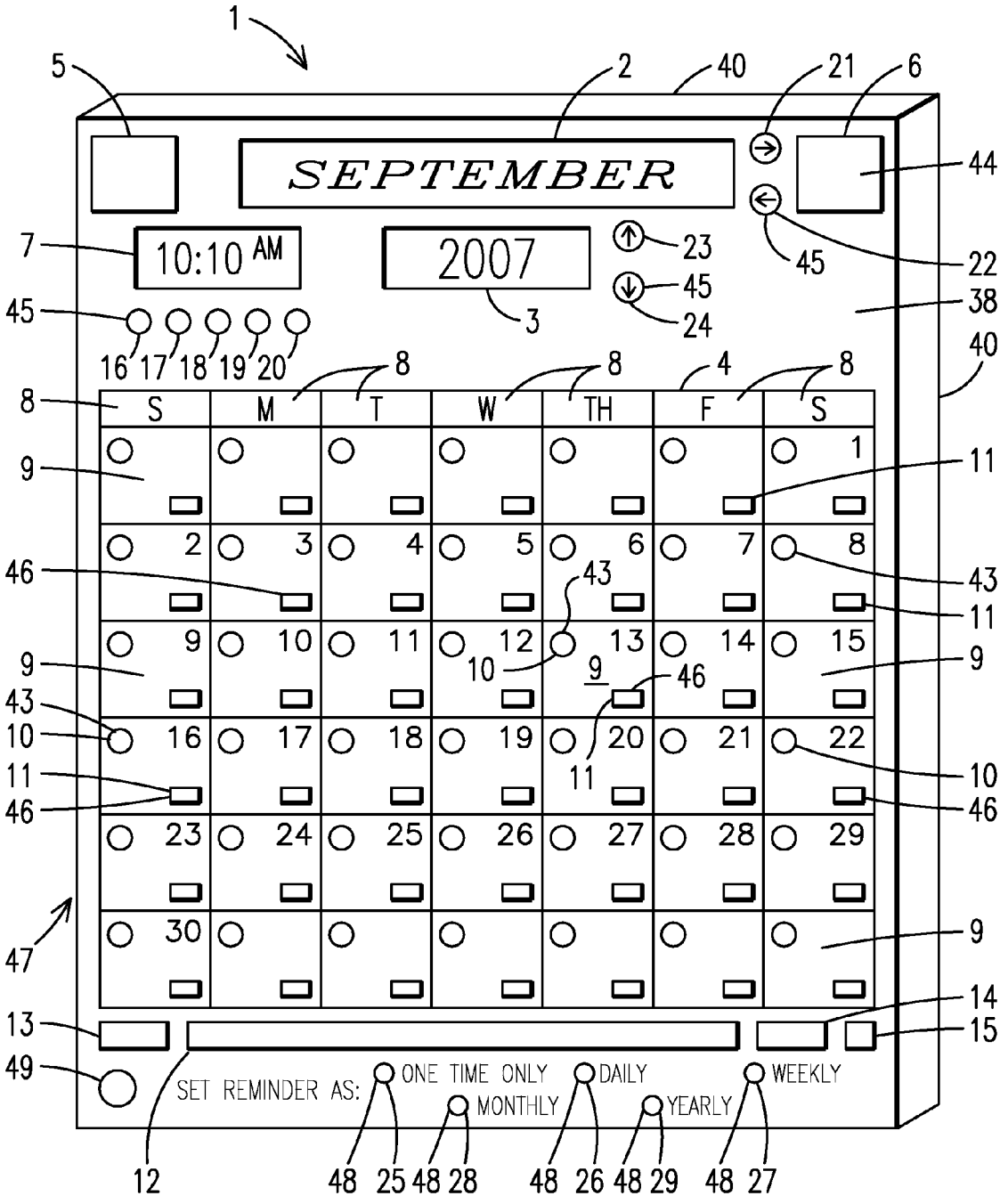
FIG. 1 is a front perspective view of a motion-activated calendar of the present invention.

For purposes of describing the preferred embodiment, the terminology used in reference to the numbered components in the drawings is as follows:

| | |
|---|---|
| 1. | motion-activated reminder calendar, generally |
| 2. | month display |
| 3. | year display |
| 4. | date display |
| 5. | motion-activated sensor |
| 6. | speaker |
| 7. | clock |
| 8. | days of the week display |
| 9. | day display |
| 10. | indicator light |
| 11. | record button |
| 12. | acknowledgment button |
| 13. | previous reminder button |
| 14. | next reminder button |
| 15. | delete button |
| 16. | set time button |
| 17. | hour button |
| 18. | minute button |
| 19. | set reminder on button |
| 20. | set reminder off button |
| 21. | advance month button |
| 22. | reverse month button |
| 23. | increase year button |
| 24. | decrease year button |
| 25. | one time only button |
| 26. | daily button |
| 27. | weekly button |
| 28. | monthly button |
| 29. | yearly button |
| 30. | fastening means |
| 31. | aperture |
| 32. | hook and loop material |
| 33. | adhesive |
| 34. | voltage source |
| 35. | battery |
| 36. | battery housing |
| 37. | AC adapter input |
| 38. | front panel |
| 39. | rear panel |
| 40. | side |
| 41. | microprocessor |
| 42. | data storage means |
| 43. | visual indicator means |
| 44. | audio indicator means |
| 45. | visual function button |
| 46. | audio function button |
| 47. | calendar display |
| 48. | increment button |
| 49. | microphone |

With reference to FIG. 1, a front perspective view of a motion-activated calendar of the present invention is shown. The motion-activated reminder calendar, generally 1 of the present invention has a predetermined shape and size and has a front panel 38 and rear panel 39 connected to one another by a plurality of sides 40. Located on the front panel 38 is calendar display 47 which preferably includes a month display 2, a year display 3 and a date display 4. The date display 4 is in a standard calendar format and includes a plurality of day displays 9 and preferably includes a days of the week display 8 to indicate each day of the week. The month display 2, year display 3 and date display 4 are variable, meaning that they change from month to month and year to year. For example, the month display 2 shows each month of the year, January through December; the year display 3 shows a plurality of years and the date display 4, specifically the day display 9, shows each day of the selected month. For example, as shown in FIG. 1, "September" is displayed in the month display 2, "2007" is displayed in the year display 3 and days 1 through 30 are displayed in the appropriate day display 9 according to the day of the week each day falls on. The following month, that is October 2007, would show days 1 through 31 in the appropriate day display 9 and the month after that, November 2007, would show days 1 through 30 and so forth. The motion-activated reminder calendar 1 automatically updates itself to advance to the next month, and ultimately next year, for an indefinite amount of time. In order to be variable, the month display 2, year display 3 and day display 9 are electronic and are preferably liquid crystal displays (LCD's), although other electronic displays may be used.

At least one visual function button 45 is located on the motion-activated reminder calendar 1 to permit a user to change the displays 2 and 3 and a clock 7 as desired. An advance month button 21 and a reverse month button 22 permit a user to advance or reverse the month that is displayed on the month display 2 of the motion-activated reminder calendar 1, respectively. Similarly, an increase year button 23 and a decrease year button 24 are also located on the motion-activated calendar 1 to permit a user to increase or decrease the year displayed on the year display 3, respectively.

Located within each day display 9 is at least one audio function button 46, which is preferably a record button 9 operationally connected to a microphone 49. Also preferably located within each day display 9 is a visual indicator means 43, which is preferably an indicator light 11, but may be any other type of visual indicator. The indicator light 11 is preferably a light emitting diode (LED), although any other type of light may be used.

Also located on the front panel 38 of the motion-activated reminder calendar 1 is at least one motion-activated sensor 5 that detects motion within a given radius of the motion-activated calendar 1. Although the motion-activated sensor 5 is shown on the front panel 38, it or other motion-activated sensors 5 may be located on the sides 40 of the motion-activated reminder calendar 1 in lieu thereof or in addition to being located on the front panel 38.

An audio indicator means 44, which is preferably a speaker 6, is also located on the motion-activated reminder calendar 1, as well as an optional clock 7. A set time button 16, hour button 17, minute button 18, set reminder on button 19 and a set reminder off button 20 are preferably located adjacent to the clock 7 to permit a user to program the clock 7 as noted below.

At least one acknowledgment button 12 is located on the motion-activated reminder calendar 1, as well as a previous reminder button 13, next reminder button 14 and delete button 15. In addition, at least one increment button 48, which may be a one time only button 25, daily button 26, weekly button 27, monthly button 28 and/or yearly button 29 may be located on the motion-activated reminder calendar 1.

To use the motion-activated reminder calendar 1 of the present invention in its most basic form, a person first records a verbal reminder on a selected day as shown in a day display 9. For example, if a user would like to set a verbal reminder for Thursday, Sep. 13, 2007, he/she would press the record button 11 located on the day display 9 for Thursday, Sep. 13, 2007 and record a verbal reminder by speaking into a microphone 49 the verbal reminder he/she desires, such as "Makinzee's birthday." Then, when the actual date is Thursday, Sep. 13, 2007, the verbal reminder will automatically transmit through the speaker 6 when motion is detected by the motion-activated sensor 5 to remind the user that today is Makinzee's birthday. The verbal reminder will continue to transmit each time motion is detected by the motion-sensor 5 until the user presses an acknowledgment button 12. Thus, the user must take physical action in order to stop the verbal reminder from being transmitted everytime motion is detected and need not view the motion-activated reminder calendar 1 prior to being reminded of an important appointment, date, event and the like.

If the verbal reminder is one that occurs on a frequent basis, a user may set the verbal reminder to be activated on a daily, weekly, monthly or yearly basis by pressing the appropriate increment button 48 as necessary before, during or after recording the verbal reminder. Continuing with the "Makinzee's birthday" verbal reminder example, the user would press the yearly button 29 immediately after recording the verbal reminder on Sep. 13, 2007 to have the verbal reminder activated every September $13^{th}$.

Moreover, a user may set a predetermined time when the verbal reminder(s) may be activated. For instance, after recording the verbal reminder, the user would press the set reminder on button 19 and enter the time on the clock 7 in which the verbal reminder may be activated and press the reminder off button 20 and enter the time on the clock 7 in which the verbal reminder may be deactivated. Thus, a person may schedule the time frame in which the verbal reminder may be transmitted, for instance, between 7 am and 10 pm, so as to not be disturbed during certain time frames.

In addition, the verbal reminder may be programmed on a day prior to the event day. For instance, the user may record the verbal reminder "pediatrician appointment on September $20^{th}$ at 2 pm" on the September $16^{th}$ day display 9 and set the verbal reminder to be transmitted on a daily basis. The verbal reminder will play everyday from September $16^{th}$ forward. Although the acknowledgment button 12 will stop the verbal reminder from being transmitted for the remainder of the current day, because the verbal reminder is scheduled for transmission on a daily basis, the verbal reminder will play each day until the user hits the delete button 15 to delete the verbal reminder.

In addition to the verbal reminder being transmitted through the speaker 6, the indicator light 10 is illuminated on the day display 9 of the days in which the verbal reminder is scheduled to be transmitted. Thus, not only is an audio reminder of the important event transmitted, but a visual reminder that there is an important event on a predetermined day is displayed.

The user may review the recorded reminders by utilizing the previous reminder button 13 and next reminder button 14 in case he/she inadvertently pressed the acknowledgment button 12, wanted to review an old recorded reminder or wanted to preview upcoming verbal reminders.

Figure 2:
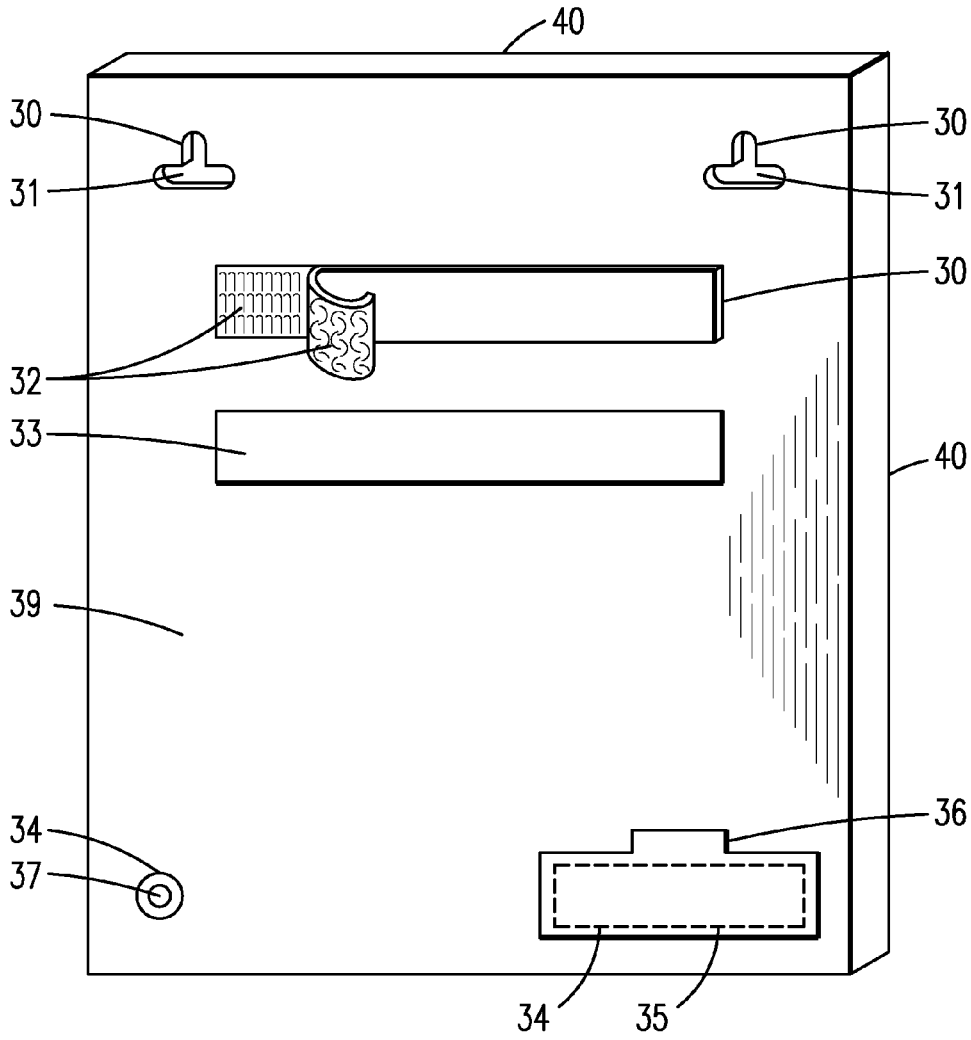
FIG. 2 is a rear plan view of the motion-activated calendar of FIG. 1.

Next, FIG. 2 shows a rear plan view of the motion-activated calendar of FIG. 1. The motion-activated reminder calendar 1 has a rear panel 39, preferably having at least one fastening means 30 located thereon for securing the motion-activated reminder calendar 1 to a surface, such as a wall. The fastening means 30 may be an aperture 31 for suspending the motion-activated reminder calendar 1 from a hook or nail, hook and loop type material 32 and/or adhesive 33 to secure the motion-activated reminder calendar 1 to a surface. At least one voltage source 34 is provided to supply a predetermined amount of power to the motion-activated reminder calendar 1. The voltage source 34 may be at least one battery 35 located within a battery housing 36 or an AC adapter input 37 to permit a user to electrically connect the motion-activated reminder calendar 1 to an electrical receptacle.

Figure 3:
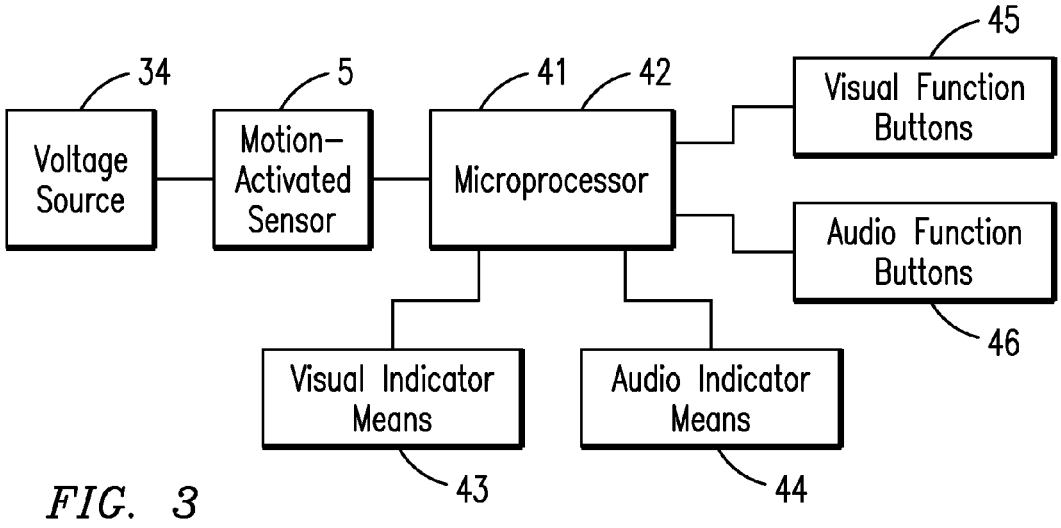
FIG. 3 is a schematic diagram of an electrical circuit of the motion-activated calendar of the present invention.

Finally, FIG. 3 shows a schematic diagram of an electrical circuit of the motion-activated calendar of the present invention. The electrical circuit of the motion-activated reminder calendar 1 begins with the voltage source 34 supplying a predetermined amount of power to the motion-activated sensor 5. The motion-activated sensor 5 is electrically connected to a data storage means 42, which is preferably a microprocessor 41. The data storage means 42, in turn, is electrically connected to the visual function buttons 45 and the visual indicator means 43 and to the audio function buttons 46 and the audio indicator means 44. Because all of the inputted data is stored within the data storage means, should the electrical circuit to the voltage source 34 be broken, the verbal reminders will not be lost as they are stored within the data storage means 42.

The use of the present invention permits a person to automatically receive verbal and/or visual reminders of appointments, special days, meetings, etc. on a predetermined day whenever motion is detected in the vicinity of the calendar.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A motion-activated reminder calendar comprising:

a front panel and an opposing rear panel connected to one another by a plurality of sides;

a calendar display located on said front panel;

a voltage source for providing power to said calendar display;

a date display located on said calendar display;

said date display having a plurality of day displays;

at least one motion-activated sensor electrically connected to said voltage source;

a data storage means electrically connected to said at least one motion-activated sensor;

at least one record button electrically connected to said data storage means wherein said data storage means records and stores at least one verbal reminder for at least one of said plurality of day displays upon activation of said at least one record button;

said at least one record button is located on at least one of said plurality of day displays; and at least one speaker electrically connected to said data storage means wherein said at least one verbal reminder is transmitted through said at least one speaker on at least one of said plurality of day displays when motion is detected by said at least one motion-activated sensor.

2. The motion-activated reminder calendar of claim 1 wherein:

each of said plurality of day displays is a liquid crystal display.

3. The motion-activated reminder calendar of claim 2 wherein:

said data storage means is a microprocessor wherein said microprocessor stores a plurality of days, months and years.

4. The motion-activated reminder calendar of claim 1 wherein:

said data storage means is a microprocessor wherein said microprocessor stores a plurality of days, months and years.

5. The motion-activated calendar of claim 1 further comprising:

at least one acknowledgment button located on said motion-activated calendar wherein said at least one verbal reminder is deactivated when said at least one acknowledgment button is pressed.

6. The motion-activated calendar of claim 1 further comprising:

at least one visual indicator means electrically connected to said data storage means wherein said at least one visual indicator means is located on at least one of said plurality of day displays.

7. The motion-activated calendar of claim 6 wherein:

said at least one visual indicator means is activated when said at least one reminder is recorded and stored for said at least one of said plurality of day displays.

8. The motion-activated reminder calendar of claim 7 further comprising:

at least one acknowledgment button located on said motion-activated calendar wherein said at least one visual indicator means is deactivated when said at least one acknowledgment button is pressed.

9. The motion-activated calendar of claim 6 wherein:

said at least one visual indicator means is an indicator light.

10. The motion-activated calendar of claim 1 further comprising:

at least one fastening means located on said rear panel.

11. The motion-activated calendar of claim 1 wherein:

said voltage source is at least one battery.

12. The motion-activated calendar of claim 1 wherein:

said voltage source is an AC adapter which may be plugged into an electrical receptacle.

13. The motion-activated calendar of claim 12 wherein:

said at least one programmable clock permits a user to program a predetermined time frame when said at least one verbal reminder may be transmitted.

14. The motion-activated calendar of claim 1 further comprising:

at least one programmable clock located on said front panel.

15. The motion-activated reminder calendar of claim 1 further comprising:

at least one increment button located on said front panel wherein said at least one increment button permits a user to program said at least one verbal reminder to be transmitted in a predetermined increment.

16. The motion-activated reminder calendar of claim 1 further comprising:

a delete button located on said front panel to delete said at least one verbal reminder.

17. The motion-activated reminder calendar of claim 1 further comprising:

at least one microphone operationally connected to said at least one record button.

18. A motion-activated reminder calendar comprising:

a front panel and an opposing rear panel connected to one another by a plurality of sides;

a calendar display located on said front panel;

a voltage source for providing power to said calendar display;

a date display located on said calendar display;

said date display having a plurality of day displays;

each of said plurality of day displays is a liquid crystal display;

at least one motion-activated sensor electrically connected to said voltage source;

a data storage means electrically connected to said at least one motion-activated sensor;

said data storage means stores a plurality of days, months and years;

at least one record button electrically connected to said data storage means wherein said data storage means records and stores at least one verbal reminder for at least one of said plurality of day displays upon activation of said at least one record button;

said at least one record button is located on at least one of said plurality of day displays;

at least one visual indicator means electrically connected to said data storage means wherein said at least one visual indicator means is located on at least one of said plurality of day displays;

said at least one visual indicator means is activated when said at least one reminder is recorded and stored for said at least one of said plurality of day displays;

at least one speaker electrically connected to said data storage means wherein said at least one verbal reminder is transmitted through said at least one speaker on at least one of said plurality of day displays when motion is detected by said at least one motion-activated sensor; and at least one acknowledgment button located on said motion-activated calendar wherein said at least one verbal reminder and said at least one visual indicator means is deactivated when said at least one acknowledgment button is pressed.

19. The motion-activated reminder calendar of claim 18 wherein:

said at least one visual indicator means is an indicator light.

20. The motion-activated reminder calendar of claim 19 further comprising:

at least one programmable clock located on said front panel.

21. The motion-activated calendar of claim 20 wherein:

said at least one programmable clock permits a user to program a predetermined time frame when said at least one verbal reminder may be transmitted.

22. The motion-activated reminder calendar of claim 18 further comprising:

a delete button located on said front panel to delete said at least one verbal reminder.

23. The motion-activated reminder calendar of claim 18 wherein:

said data storage means is a microprocessor wherein said microprocessor stores a plurality of days, months and years.

* * * * *